United States Patent [19]

Wardell, Jr.

[11] 4,253,077

[45] Feb. 24, 1981

[54] YOKE TABBING DEVICE

[75] Inventor: Myron H. Wardell, Jr., Lititz, Pa.

[73] Assignee: RCA Corporation, New York, N.Y.

[21] Appl. No.: 89,381

[22] Filed: Oct. 30, 1979

[51] Int. Cl.[3] ..... H01F 1/00

[52] U.S. Cl. ..... 335/212; 335/210

[58] Field of Search ..... 335/210, 212, 213

[56] References Cited

U.S. PATENT DOCUMENTS

| | | | |
|---|---|---|---|
| 3,305,744 | 2/1967 | Werst | 335/212 X |
| 3,605,053 | 9/1971 | Anthony | 335/212 |

*Primary Examiner*—George Harris

*Attorney, Agent, or Firm*—Eugene M. Whitacre; William H. Meagher; Scott J. Stevens

[57] ABSTRACT

A deflection adjustment device for a television deflection yoke and kinescope comprises a pair of magnetically permeable tabs adapted for linear movement along the kinescope minor axis. Means are provided for translating the rotary motion of a yoke adjustment machine into the desired linear tab travel. The tabs are moved in equal amounts, either toward or away from the yoke axis, to maintain the tabs equidistant from the yoke axis in order to correct coma errors.

5 Claims, 2 Drawing Figures

Fig. 1.
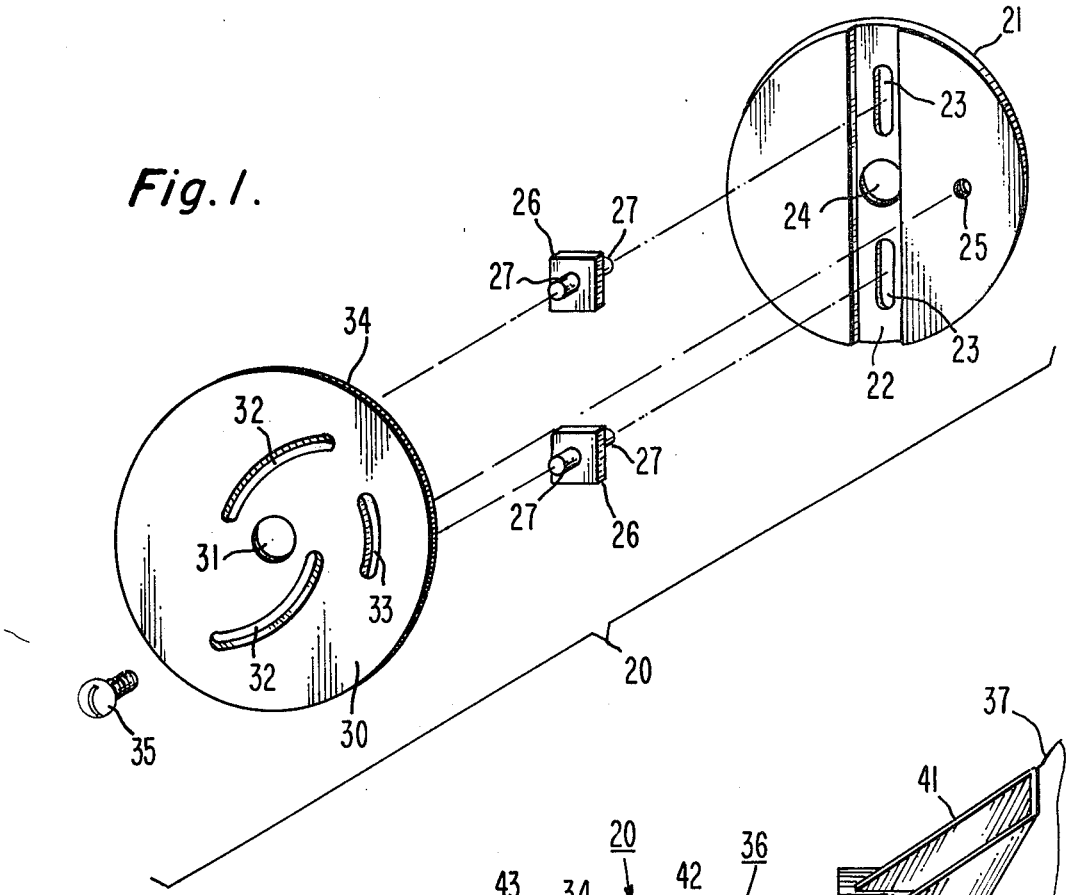
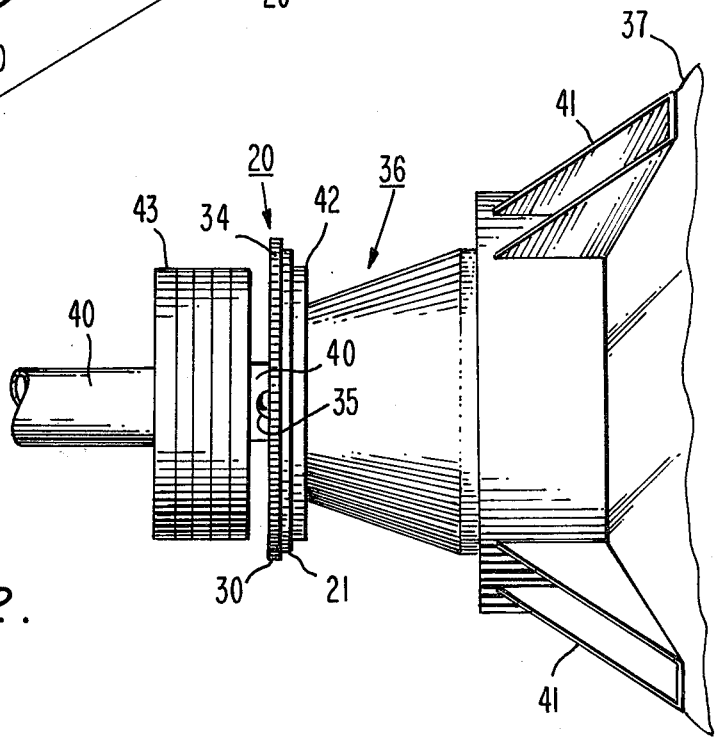
Fig. 2.

YOKE TABBING DEVICE

This invention relates to deflection adjustment apparatus for color television kinescopes.

A television picture is formed by the rapid scanning of one or more electron beams across the phosphor-coated face of the kinescope. Deflection circuits, including a deflection yoke which is situated around the neck of the kine, provides the means by which this scanning takes place. The deflection yoke comprises coils which cause the electron beam to be deflected in both the horizontal and vertical directions in order to scan the entire surface of the kinescope face.

In a color television receiver, three electron beams are used to provide the three primary colors of red, blue and green. The kinescope face is coated with red, blue and green color-producing phosphor particles in a particular pattern or configuration. It is important that electrons from a color-designated electron beam strike only its associated color-producing phosphor. To accomplish this, a shadow mask comprising minute closely-spaced slots is placed adjacent to the phosphor face between the phosphor and the electron guns. The electron beams pass through the shadow mask at different angles, thereby striking the phosphor surface at a different location for each electron beam, corresponding to a strip of the associated color-producing phosphor. Each slot of the shadow mask therefore has a red, blue and green producing phosphor strip trio or triad associated with it. The strips of the trios are closely spaced, so that light emitted by the three strips appears to the viewer as emanating from a single source. By varying the intensity of the individual electron beams, a wide range of colors can be generated.

In order to accomplish this apparent mixing of red, blue and green, it is important that the electron beams converge when they strike the kinescope display screen. If this fails to occur, color strips from different trios of the screen will be illuminated, resulting in color fringing and other convergence distortion.

Proper convergence of the electron beams at the center of the screen can be accomplished through the use of a permanent magnet assembly that is mounted on the neck of the kinescope. This is known as static convergence. For convergence at points other than at the center of the screen, it was necessary to use dynamic convergence circuits which affected the motion of the individual beams during scanning by electromagnetic coils positioned around the tube neck. In modern receivers, substantial convergence of the electron beams over the entire raster can be accomplished through construction of the deflection yoke. These yokes, known as self-converging yokes, eliminate the need for dynamic convergence circuits and coils, but often require minor corrections to beam convergence which is most noticeable at the outer edges of the raster. It is known that placing small magnetically permeable members or tabs adjacent to the yoke and in the vicinity of the kine neck influences the magnetic fields of the yoke by shunting a portion of the field through the tab, thereby weakening the deflection field. This can be used to correct certain convergence errors. In U.S. patent application Ser. No. 951,001, filed on Oct. 13, 1978, in the name of Barkow, et al., now abandoned and a continuation-in-part application Ser. No. 018,906, filed Mar. 9, 1979 in the same names, describes the use of a pair of tabs moved in the same direction to change the transverse location of the center of the yoke deflection field to simulate transverse motion of the yoke with respect to the kine neck. Moving the tabs in the same direction causes one tab to move closer to the kine neck, thereby having a greater effect on the yoke field while the other tab moves away from the kine neck and has less of an effect on the yoke field. The effect of two tabs moving in the same direction is to move the center of the yoke field in a transverse direction. Tabbing in this manner along the vertical (minor) axis of the kinescope corrects misconvergence error appearing as a crossover of red and blue vertical lines with resulting beam separation at the ends of the axis. Tabbing along the major axis in this manner likewise corrects beam crossover misconvergence of red and blue horizontal lines along the major axis.

The present invention is directed to a tabbing mechanism in which a pair of diametrically-opposed tabs are disposed at positions which are equally distant from the yoke longitudinal axis. The tabs are moved in increments of equal magnitude and opposite direction with respect to the yoke axis. By maintaining the tabs equidistant from the yoke axis during the tab adjustment, the yoke deflection fields are influenced symmetrically. This symmetrical influence will not change the transverse location of the deflection field (and hence beam crossover), but will instead effect the size of the rasters with respect to each other. The effect of this manner of tabbing can therefore be used to correct raster coma errors, involving a difference in size between the central green beam raster and the outer red and blue beam rasters. Moving the tabs in a vertical direction in the manner described will cause the green raster height to shrink with respect to the height of the red and blue rasters as the tabs are moved toward the yoke axis, and to grow with respect to the red and blue as the tabs are moved away from the yoke axis. The rasters of all three beams are affected, but the green raster will be affected the greatest. By adjusting the location of the tabs with respect to the yoke axis, the three rasters can be made to coincide.

Modern techniques for mounting a yoke to a color television kinescope utilize a yoke adjustment machine (YAM) which can be controlled by an operator in front of the kinescope. The YAM can accurately position the yoke for the least convergence error, and then attach the yoke to the kinescope without altering the yoke position. The YAM can also be used to adjust any beam bender magnets or other convergence magnets quickly by controls on the front panel of the YAM. In the interest of speed and efficiency, it is advantageous to make as many adjustments as possible with the YAM, including tabbing. This goal places a premium on the amount of space given to any particular adjustment mechanism. It is therefore desirable that a YAM-adapted tabbing mechanism incorporating the present invention be made as thin as possible in order to fit between the rear of the yoke and the kinescope neck components; i.e., beam-bending magnets. In the drawings:

FIG. 1 is an exploded perspective view of a deflection yoke tabbing device; and FIG. 2 is a side elevational cross-sectional view of the yoke tabbing device of FIG. 1, shown mounted on a kinescope neck. Referring to FIGS. 1 and 2, there is shown a yoke tabbing device 20 which is normally disposed at the rear of a color television kinescope deflection yoke, as shown in FIG. 2. Yoke tabbing device 20 comprises a base or guide plate 21 which incorporates a guide channel 22, guide slots 23, a central aperture 24 and a retaining hole 25. The central aperture 24 is large enough to receive the kinescope neck. The base plate 21 may be attached to the rear of the deflection yoke to aid in maintaining the equidistant relationship between the tabs and the deflection yoke axis. The means of attachment is not important, but it should be simply and easily accomplished. If desired, the base plate 21 may even be incorporated into the rear of the deflection yoke support itself. The tabbing device 20 also comprises a pair of tabs 26. Tabs 26 are formed of a magnetically permeable substance, such as barium ferrite. Tabs 26 also incorporate guide posts 27 which extend outwardly from opposite surfaces of the tabs. One of the guide posts 27 from each of the tabs 26 fits into one of the guide slots 23 within the channel 22 of the base plate 21. Tabs 26 are contained within the channel 22 and are free to slide within the limits of the guide slots 23. The base plate 21 is oriented so that the tabs slide in a direction orthogonal to the magnetic field that is to be affected. The tabs 26 are constructed so that when they are contained within the guide channel 22, they maintain the desired orientation with respect to the affected magnetic deflection field regardless of their radial position with respect to the deflection yoke axis. Yoke tabbing device 20 also comprises a rotary drive plate 30 incorporating a central aperture 31, a pair of arcuate drive or tracking slots 32, an arcuate retaining slot 33, and a plurality of gear-engaging teeth 34 disposed around the outer edge of drive plate 30. The central aperture 31 also receives the kinescope neck in the same manner as base plate 21. The drive plate 30 is disposed adjacent to the base plate 21 as shown in FIG. 2.

Each of the arcuate drive slots 32 receive one of the guide posts 27 extending from the tabs 26. The drive slots 32 each generally define a curved path extending from the central area of the drive plate 30 to the vicinity of the outer edge. The slots 32 are symmetrically formed on either side of the central aperture 31.

The teeth 34 along the outer edge of the drive plate 30 are adapted to be engagable by a gear or similar member located on a yoke adjustment machine (YAM). Tabbing device 20 can also be operated manually or by some other mechanism, which may eliminate the need for teeth 34. Activation by the YAM tabbing gear will rotate the drive plate 30 about its central axis; i.e., the kinescope neck. As the drive plate 30 is rotated, the guide posts 27, and hence the tabs 26, are carried along the drive slots 32. Because of the tabs 26 are contained within the channel 22, rotation of the drive plate 30 causes the tabs 26 to move linearly along the channel 22. The design and position of the arcuate drive slots 32 translate the rotary motion of the drive plate 30 into linear motion of tabs 26. Since the drive slots 32 are symmetrical with respect to the drive plate central axis, the tabs 26 will remain equidistant from the base plate central axis, which is the deflection yoke axis regardless of yoke position adjustments.

Retaining screw 35 passes through retaining slot 33 and is inserted into retaining hole 25. During operation of the tabbing device 20, retaining screw 35 is loosened slightly to permit free movement of drive plate 31. Retaining slot 33 allows drive plate 30 to rotate while screw 35 is in place within retaining hole 25. When the YAM operator is satisfied that tabs 26 are in their optimum position, screw 35 can be tightened, thereby prohibiting any movement of the drive plate 30 with respect to the base plate 21. It is clear that other forms of retaining means, such as glue or clips, may be used in place of retaining screw 35. The use of a screw is merely shown as exemplary. Any means which holds the tabs in their desired position after adjustment without allowing further motion is appropriate.

FIG. 2 illustrates the yoke tabbing device 20 in place at the rear of a deflection yoke 36. The yoke 36 is shown in place on a television kinescope 37. The kinescope neck 40 can be seen extending out the rear of the yoke 36, with the kine neck axis substantially coincident with the axis of the deflection yoke. Mounts 41, at the front of the yoke 36, attach the yoke 36 to the kinescope 37. Yoke tabbing device 30 is located adjacent to the yoke support member 42. The adjustable neck component magnets 43 are shown adjacent to the tabbing device 20. The proximity of the neck magnets 43 to the yoke 36 emphasizes the limited space availability of any yoke tabbing device.

As previously described, two tabs placed along the kinescope minor axis at equal distances from the yoke axis will aid in correcting raster coma error. In a situation in which green is the center beam and the green raster is larger than the red and blue rasters at the top and bottom of the screen, moving the tabs closer to the yoke deflection center will decrease the size of the green raster with respect to the red and blue, therefore correcting coma error. Since the green raster is affected by the tabs more than the red and blue, moving the tabs toward the yoke deflection center (and kinescope axis) will cause the green raster to shrink with respect to the red and blue. Moving the tabs away from the center will cause the green raster to grow with respect to the red and blue.

It is also possible to similarly position tabs along the kinescope major axis to correct size differences between the outer two beam rasters.

What is claimed is:

1. A convergence adjustment apparatus for a kinescope incorporating three in-line electron beams comprising:

a deflection yoke mounted on the neck of said kinescope so that the axis of said yoke is substantially coincident with the axis of said kinescope neck;

a support structure mounted to the rear of said yoke incorporating a pair of tab-receiving guide tracks located at diametrically-opposed positions with respect to said kinescope neck axis and extending radially therefrom;

a first magnetically permeable tab disposed within one of said guide tracks and a second magnetically permeable tab disposed within the other of said guide tracks, said tabs disposed at respective positions equidistant from said yoke axis for symmetrically influencing the deflection fields of said yoke; and drive means, coupled to said tabs, for simultaneously adjusting the proximity of each of said tabs to said yoke axis in the same sense and magnitude.

2. The apparatus defined in claim 1 wherein the drive means is rotatably mounted on said kinescope neck and incorporates a plurality of arcuate tab-receiving drive tracks for effecting a linear movement of said tabs along said support structure guide tracks during rotation of said drive means.

3. The apparatus defined in claim 1, wherein said drive means incorporates coupling structure for cooperation with a yoke adjusting machine.

4. The apparatus defined in claim 1, wherein said guide tracks are disposed in a vertical direction.

5. A convergence adjustment apparatus for a kinescope incorporating three in-line electron beams comprising:

a deflection yoke mounted on the neck of said kinescope so that the axis of said yoke is substantially coincident with the axis of said kinescope neck;

a support structure mounted to the rear of said yoke incorporating a pair of tab-receiving guide tracks located at diametrically-opposed positions with respect to said kinescope neck axis and extending radially therefrom;

a first magnetically permeable tab disposed within one of said guide tracks and a second magnetically permeable tab disposed within the other of said guide tracks, said tabs disposed at respective positions equidistant from said yoke axis to symmetrically influencing the deflection fields of said yoke; and means for effecting a change in the size of the raster formed by the center beam of said kinescope unequal to the change effected in the size of the rasters of the two outer beams, said raster size change-effecting means comprising drive means, coupled to said tabs for simultaneously causing motion of equal magnitude and opposite direction of the respective tabs in said guide tracks.

* * * * *